US005540638A

United States Patent [19]

Wilkinson

[11] Patent Number: 5,540,638

[45] Date of Patent: Jul. 30, 1996

[54] MULTI-LEVEL AEROBIC STEP DEVICE

[76] Inventor: William T. Wilkinson, P.O. Box 73, Salem, N.J. 08079

[21] Appl. No.: 442,890

[22] Filed: May 17, 1995

Related U.S. Application Data

[60] Division of Ser. No. 82,099, Jun. 28, 1993, abandoned, which is a continuation-in-part of Ser. No. 967,711, Oct. 28, 1992, Pat. No. 5,275,579, and a continuation-in-part of Ser. No. 69,740, Jun. 1, 1993, Pat. No. 5,352,168, which is a continuation-in-part of Ser. No. 891,178, May 29, 1992, Pat. No. 5,248,286, which is a division of Ser. No. 718,754, Jun. 21, 1991, Pat. No. 5,118,096, which is a division of Ser. No. 588,449, Sep. 26, 1990, abandoned, said Ser. No. 69,740, is a continuation-in-part of Ser. No. 967,711, Oct. 28, 1992, Pat. No. 5,275,579, which is a continuation-in-part of Ser. No. 754,075, Sep. 3, 1991, Pat. No. 5,162,028, and a continuation-in-part of Ser. No. 698,382, May 10, 1991, Pat. No. 5,184,987.

[51] Int. Cl.[6] ..... A63B 22/00

[52] U.S. Cl. ..... 482/52; 482/51

[58] Field of Search ..... 297/423.41, 423.44, 297/383; 108/53.1, 53.5, 143, 90.1, 97; 482/51–53

[56] References Cited

U.S. PATENT DOCUMENTS

| | | | |
|---|---|---|---|
| D. 256,707 | 9/1980 | MacLaren-Taylor | 482/142 |
| 2,483,920 | 10/1949 | Mclean et al. | 108/143 |
| 3,204,259 | 9/1965 | Gordon | 482/23 |
| 3,599,750 | 8/1921 | Serwer . | |
| 3,628,790 | 12/1972 | Gordoa | 482/23 |
| 4,930,769 | 6/1990 | Nenoff | 482/142 |
| 5,169,360 | 12/1992 | Saunders | 482/52 |
| 5,226,865 | 7/1993 | Chin | 482/52 |
| 5,363,774 | 11/1994 | Anada et al. | 108/142 |

*Primary Examiner*—Jerome Donnelly
*Attorney, Agent, or Firm*—Connolly & Hutz

[57] ABSTRACT

A multi-level aerobic step device includes a base having a flat upper surface. A mounting block is detachably mounted to the base with the mounting block also having a flat upper surface. When the mounting block and base are mounted together a unit is formed having an exposed upper surface which comprises at least a portion of the upper surfaces of each of the mounting block and base wherein the exposed portion of the mounting block upper surface is at a different height elevation than the height of the exposed portion of the base.

5 Claims, 5 Drawing Sheets

Fig.22.
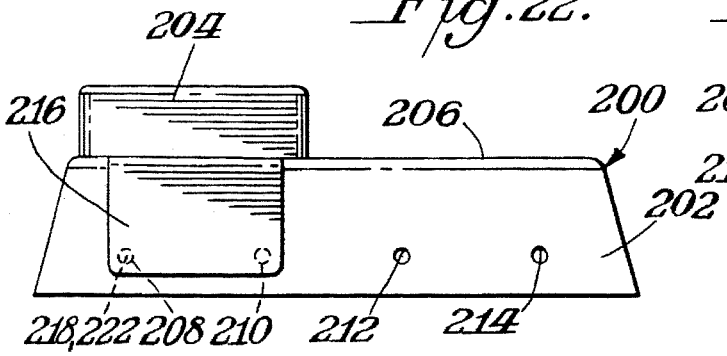
Fig.23. Fig.24.
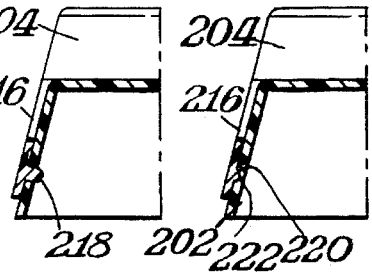
Fig.25. Fig.26.
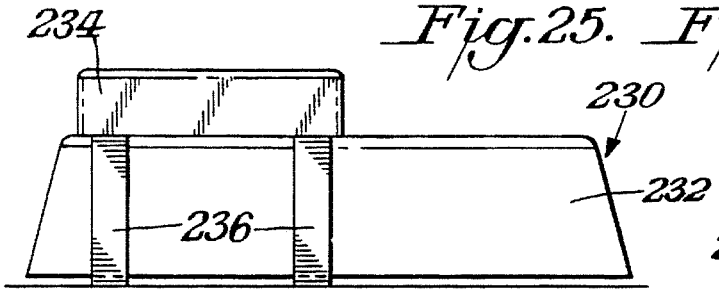
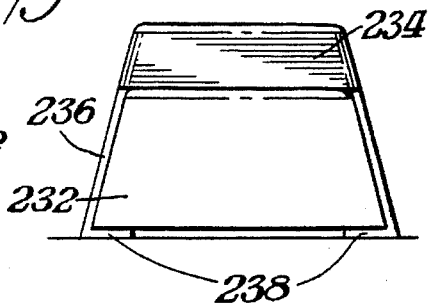
Fig.27.
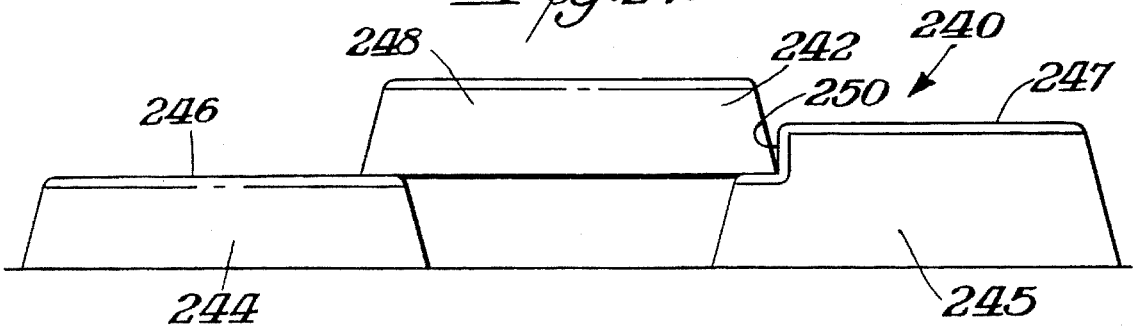

MULTI-LEVEL AEROBIC STEP DEVICE

CROSS-REFERENCE TO RELATED APPLICATIONS

This application is a division of application Ser. No. 082,099, abandoned, filed Jun. 28, 1993, which in turn is a continuation-in-part of application Ser. No. 967,711 filed Oct. 28, 1992 now U.S. Pat. No. 5,275,579 and application Ser. No. 069,740, filed Jun. 1, 1993 now U.S. Pat. No. 5,352,168 which in turn is a continuation-in-part of application Ser. No. 891,178, filed May 29, 1992, now U.S. Pat. No. 5,248,286, which in turn is a division of application Ser. No. 718,754 filed Jun. 21, 1991, now U.S. Pat. No. 5,118,096 and which is a division of application Ser. No. 588,449, filed Sep. 26, 1990, now abandoned. Application Ser. No. 69,740, is also a continuation-in-part of application Ser. No. 967,711 filed Oct. 28, 1992, now U.S. Pat. No. 5,248,286, which in turn is a continuation-in-part of application Ser. No. 754,075, filed Sep. 3, 1991 now U.S. Pat. No. 5,162,028 and a continuation-in-part of application Ser. No. 698,382, filed May 10, 1991, now U.S. Pat. No. 5,184,987.

BACKGROUND OF THE INVENTION

Various forms of aerobic exercise are intended to develop different parts of the body. The above noted parent applications and patents disclose different forms of steps which could be used to supplement an aerobic exercise by permitting the user to step up and down from a horizontal platform to the floor. In general, the steps of the above parent patents and applications include some form of adjustability to permit the exercise program to conform to the particular individuals. This is generally accomplished by providing height adjustability so that a selective number of different heights can be provided for the platform. Parent U.S. Pat. No. 5,162,028 also provides for width adjustability in addition to height adjustability. In all of these approaches, however, the adjustability is intended to provide a single level step. It would be desirable if an exercise step could also be provided which permits the user to have multiple height levels during the same exercise program.

SUMMARY OF THE INVENTION

An object of this invention is to provide an aerobic step device having a plurality of different levels so that the user can step up and down as multi-levels during the same exercise program.

A further object of this invention is to provide such a device which lends itself to attachment to the known height adjustable exercise steps.

A still further object of this invention is to provide an aerobic exercise which utilizes a multi-level step device.

In accordance with this invention a multi-level step device includes a base having a flat upper surface. At least one mounting block is detachably mounted to the base and also includes a flat upper surface. When the base and mounting block are attached together a unit is formed which has an exposed upper surface comprised of at least a portion of the upper surface of the base and a portion of the upper surface of the mounting block. In this unit the exposed upper surface of the mounting block is at a different height elevation than the exposed upper surface of the base.

The multi-levels could be achieved by mounting more than one mounting block at different locations on the base so that at least three height levels result from the plurality of mounting blocks and the exposed portion of the base. In an alternative practice of the invention height adjustability could be achieved by stacking a plurality of mounting blocks atop each other on the base.

In a further alterative form of this invention a multi-level mounting block could be provided with detaching means for mounting the block directly on the upper surface of a type of step as described in the parent patents and applications to cover substantially the entire upper surface of the step whereby the exposed upper surface of the unit is comprised essentially solely from the multi-level mounting block.

The invention may be practiced by including the height adjustability techniques disclosed in the parent patents and applications. Similarly, the invention could be practiced by utilizing the width adjustability features of parent Patent No. 5,162,028. In a variation the techniques for achieving width adjustability in U.S. Pat. No. 5,162,028 could be used for detachably mounting the mounting block to the base. For example, in U.S. Pat. No. 5,162,028 the base is formed from two members which may slidably move away from each other and thus achieve a greater width by mounting an insert into the space between the members. In the practice of this invention it is the mounting block that would be the insert mounted in that space and the mounting block would have a higher height level than the two sliding members.

In a yet further practice of this invention the base may have a hollow interior so that the mounting blocks and adjustable legs could be stored within the base during periods of non-use and transportation.

THE DRAWINGS:

FIG. 22 is a side elevational view of yet another form of a multi-level aerobic step device in accordance with this invention;

FIGS. 23–24 are fragmented elevational views partly in section of alternative mounting means for the device of FIG. 22;

FIG. 25 is a side elevational view of a further form of multi-level aerobic step device in accordance with this invention;

FIG. 26 is an end elevational view of the device shown in FIG. 25; and

FIG. 27 is a side elevational view of still yet another multi-level aerobic step device in accordance with this invention.

DETAILED DESCRIPTION

The present invention in general involves creating an aerobic step which could have a plurality of levels on which to exercise. These levels may be in the form of permanent multi-levels or could be adjustable to one or more levels. The steps can be fixed or adjustable in height or expandable in width. It is to be understood that added height adjustability could be accomplished by providing height adjustment means such as the types of legs described in the various parent patents and applications, the details of which are incorporated herein by reference thereto.

Figure 2:
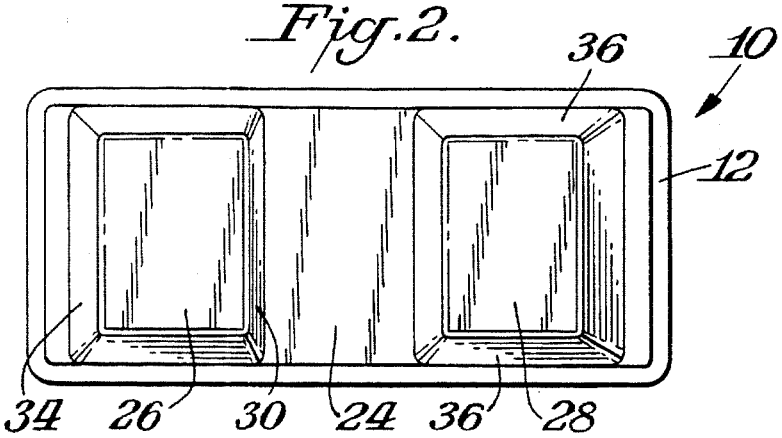
FIG. 2 is a top plan view of the device shown in FIG. 1.
Figure 3:
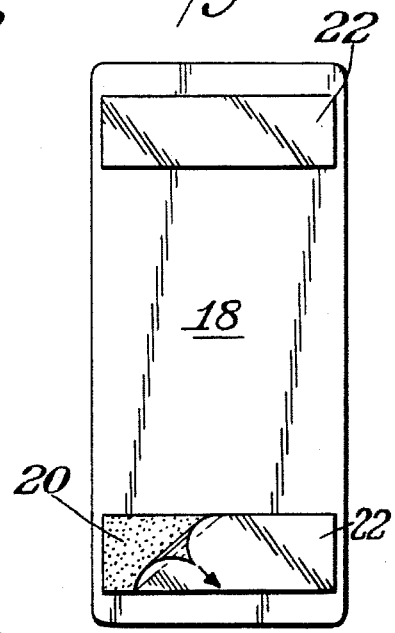
FIG. 3 is a bottom plan view of the mounting block used in the device of FIGS. 1–2.
Figure 1:
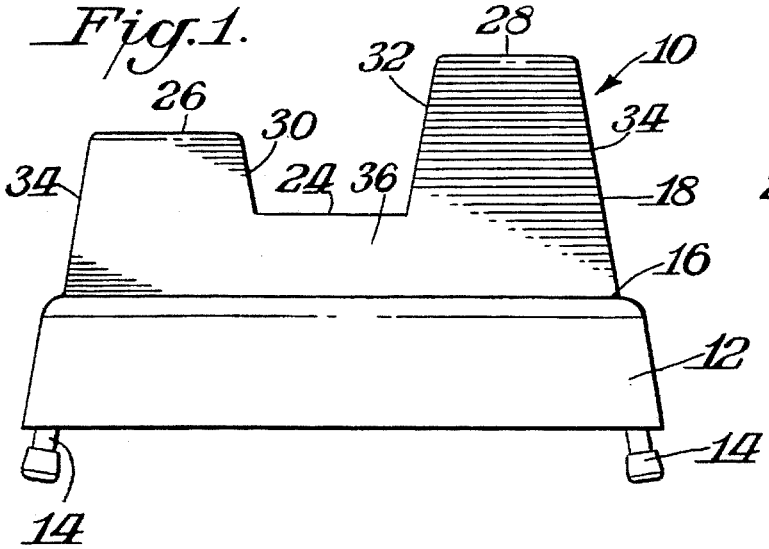
FIG. 1 is a side elevational view of a multi-level aerobic step device in accordance with this invention.

FIGS. 1–3 illustrate one form of multi-level aerobic step device 10 in accordance with one embodiment of this invention. Step device 10 is intended to be used with the known type of steps which would function as the base 12 for the step device 10. These known steps are provided with some form of legs 14 to provide height adjustability. The upper surface 16 would ordinarily comprise a stepping platform onto which and from which the user would step to and from the floor. In accordance with this invention substantially the entire upper surface 16 of base 12 is covered by a mounting block 18. Any suitable means could be used for mounting the mounting block 18 to base 12. If desired, for example, a generally permanent attachment of mounting block 18 to base 12 could be achieved by the use of adhesive areas 20 on the lower side of mounting block 18. Thus, no modifications are necessary to convert the known step or base 12 to a multi-level step other than the attachment of mounting block 18. FIG. 3 illustrates the adhesive areas 20 to be covered by release members 22 so that the adhesive areas 20 are protected until the time that mounting block 18 is mounted to base 12. If desired the lower portion of mounting block 18 could have adhesive coated feet. Attachment to the base would result from the weight and pressure of the user stepping on the mounting block.

As best shown in FIG. 1 the resulting unit from the attachment of mounting block 18 to base 12 is a multi-level step wherein the step has three generally flat horizontal exposed surfaces, each at different levels. As shown the central portion 24 is of the lowest level. An intermediate level 26 is located on one side and a high level 28 is located on the other side. Thus, the user may perform an aerobic exercise which would include stepping from low portion 24 and selectively onto and down from portions 26 and 28. For beginners the stepping exercise could include the lower stepping action by stepping to and from surfaces 24 and 26. For more advanced programs the stepping exercise could include the adjacent portions 24 and 28 or all three portions 24, 26 and 28. A further exercise program could include using the floor as a further height level.

As illustrated, the sides 30 and 32 which join the flat surface 24 with surfaces 26 and 28, respectively, are inclined away from central portion 24. If desired, for aesthetic purposes the outer sides 34, 34 and the front and back walls 36 may also be tapered.

Any suitable dimensions could be used for step 10. Where the mounting block provides all of the multi-level steps the central portion 24 could be elevated, for example, four inches above surface 16. Intermediate surface 26 could be 6 inches above surface 16 and the highest surface 28 could be 8 inches above surface 16.

It is to be understood that in its broadest aspect the mounting block 28 (with or without adhesive areas) may comprise the entire multi-level aerobic step by-being mounted directly on the floor without any attachment to base 12. Alternatively, base 12 could be utilized as a means of controlling the elevation of the entire mounting block 18. Thus, if base 12 has a height of 4 inches in its lowest position then the user could step from the floor to central portion 24 at an elevation of 8 inches with intermediate level 26 being 10 inches above the floor and high level 28 being 12 inches above the floor. These heights could be increase by manipulation of legs 14 in the manner described in the various parent patents and applications referred to herein.

It is to be understood that while mounting block 18 is illustrated in FIG. 1 as having three height levels the invention may be practiced with other numbers of height levels. Thus, for example, mounting block 18 might include only two height levels by omitting one of the portions 26 or 28. Alternatively, both portions 26 and 28 could be of the same height level. A still further alternative is to provide more than three height levels by appropriately including any other number of flat topped projections for mounting block 18.

Figure 4:
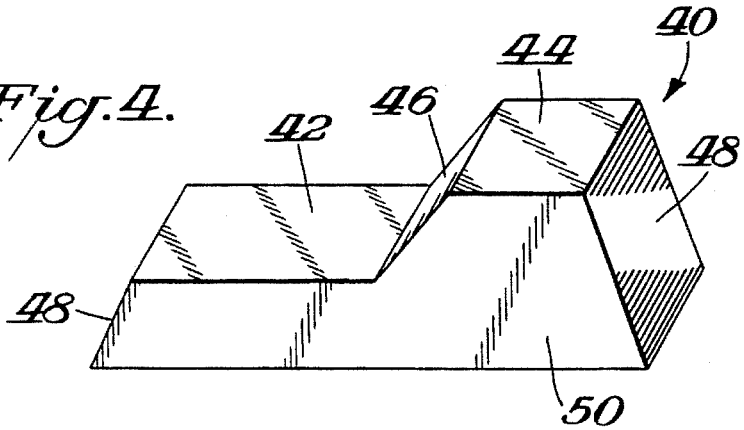
FIGS. 4–5 are pictorial views of alternative forms of multi-level aerobic step device mounting blocks in accordance with this invention.

FIG. 4 illustrates a modified form of mounting block 40 which would be similar to block 18 except for its step structure. Block 40 includes a low surface 42 and a high surface 44 with the connecting wall 46 being tapered as well as outer walls 48 and front and back walls 50 being tapered. Mounting block 40 could be used as an entire multi-level step device or could be used with some form of base such as base 12 illustrated in FIG. 1. It is also to be understood that the mounting block such as mounting blocks 18 and 40 may be detachably mounted to a base or height adjustable step rather than permanently mounted. For example instead of adhesive areas, suction cups could be used for detachable mounting so that no modifications need be made to the base. Any suitable form of detachable mounting could be used including some forms described hereinafter.

Figure 5:
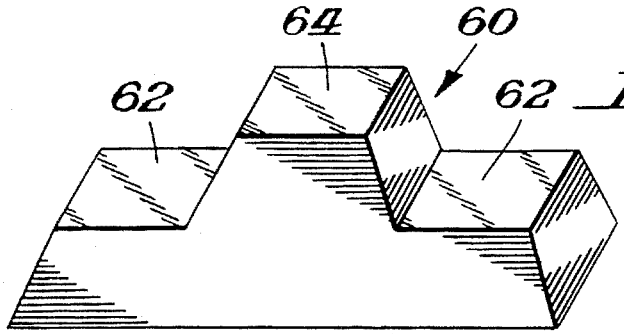

FIG. 5 illustrates a variation of the invention wherein the mounting block 60 has a pair of low levels 62,62 on each side of central surface 64. The surfaces 62,62 may be of the same height or may differ in height. The various walls may be perpendicular to the lower surface of mounting block 60 or may be inwardly tapered as illustrated.

If desired the mounting block may cover only a portion of surface 16 so that the remaining portion of surface 16 would be exposed to comprise a further stepping section.

Figure 7:
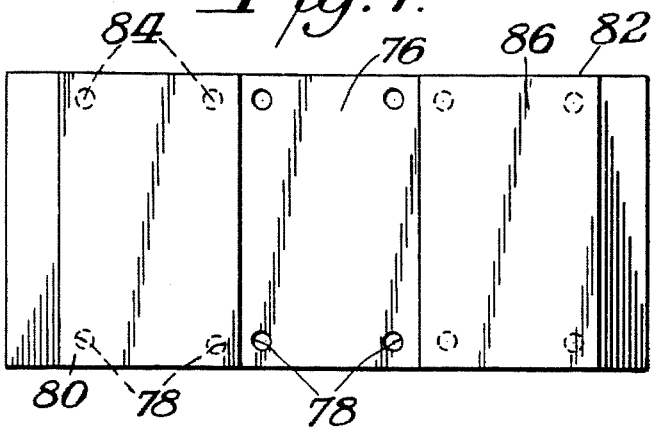
FIG. 7 is a top plan view for the device shown in FIG. 6.
Figure 6:
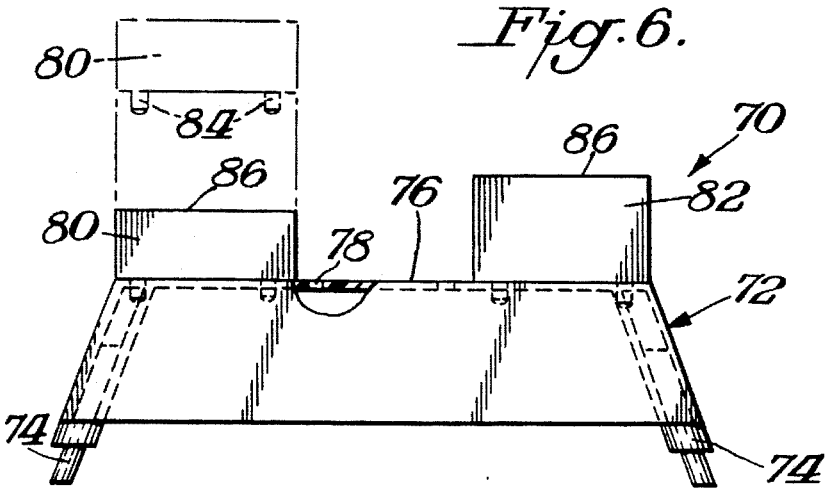
FIG. 6 is a side elevational view partly in section and partly exploded of yet another form of multi-level aerobic step device in accordance with this invention.

FIGS. 6–7 illustrate a further form of this invention wherein device 70 includes a base 72 which may be generally constructed as in the form of height adjustable steps disclosed in the parent patents and applications and would include any suitable form of adjustable legs 74. In this practice of the invention the upper surface 76 of base 72 would be provided with sets of holes 78, preferably having a total of three sets of holes with four holes in each set. The mounting blocks could include a low level mounting block 80 and a higher level mounting block 82 each having a flat horizontal upper surface 86. Each of the mounting blocks 80, 82 would be provided with posts or pins 84 located to fit in the corresponding holes 78. Thus, each mounting block 80, 82 may be selectively located at either end or at the central portion of upper surface 76. The result would be to provide three different height elevations where two different size mounting blocks are used or to provide two different height elevations where the mounting blocks are of the same size or where only one mounting block is used. If desired, where the mounting blocks are of the same size the mounting blocks could be disposed adjacent each other so that only two levels are formed with one level being surface 76 and the other level being from juxtaposed coplanar surfaces 86.

Figure 8:
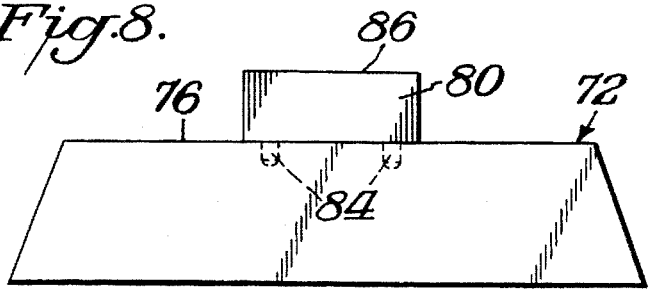
FIG. 8 is a side elevational view of still yet another form of multi-level aerobic step device in accordance with this invention.

FIG. 8 illustrates a variation wherein the structure shown in FIGS. 6 and 7 is used to include only a single mounting block 80 so that lower levels 76 are on each side of the mounting block 80 and thus the user may step from platform upper surface 76 to upper surface 86 of mounting block 80 and then back onto upper surface 76 on either side of surface 86.

Figure 9:
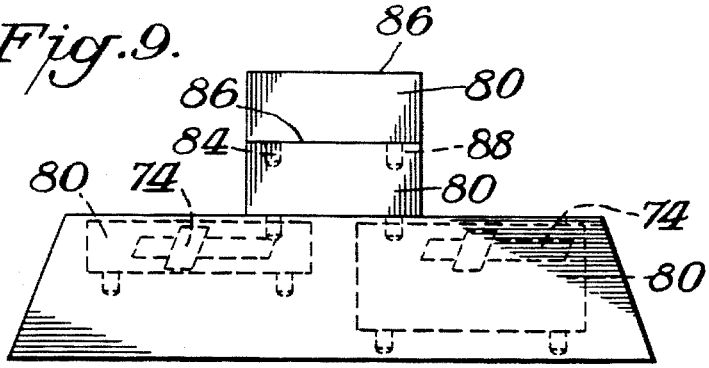
FIG. 9 is a side elevational view of a further form of a multi-level aerobic step device in accordance with this invention.
Figure 10:
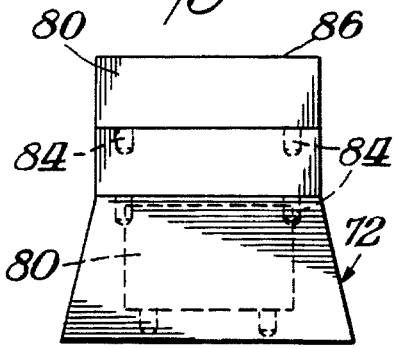
FIG. 10 is an end elevational view of the device shown in FIG. 9.

FIGS. 9–10 illustrate a variation of the invention wherein each mounting block 80 is also provided with sets of holes 88 in its upper surface 86 so that the post 84 of a similar mounting block 80 could be inserted into the holes 88 and thus change the elevation of the exposed surface 86 by in effect doubling the height of mounting block 80 where two mounting blocks are used. This concept may be practiced by stacking any number of mounting blocks 80 or by adding taller mounting blocks 82 as well as shorter mounting blocks in any combination at any of the locations on upper surface 76 for achieving a virtual limitless possible number of height level combinations.

A further advantageous feature of the embodiment shown in FIGS. 9–10 is that base 72 is molded so that it is completely open between its peripheral sides. This open space resulting from the hollow base 72 could be utilized for storing the mounting blocks and legs such as mounting blocks 80,82 and legs 74. Reference is made to the parent patents and applications which disclose this storage feature. See for example, U.S. Pat. Nos. 5,096,186 and 5,125,646.

Figure 11:
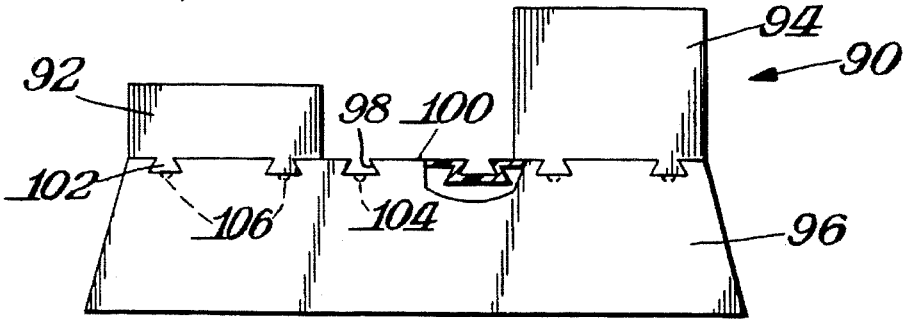
FIGS. 11 and 12 are side elevational views showing alternative forms of multi-level aerobic step devices in accordance with this invention.

FIG. 11 illustrates a variation of the invention similar to that of FIGS. 7–8. The device 90 of FIG. 11 utilizes an alternative mounting means for detachably mounting the blocks 92, 94 to base 96. As shown therein sets of dove tailed grooves 98 are provided on the upper surface 100 of base 96. The lower surface of each mounting block 92, 94 contains appropriately shaped tongues 102 which slide in grooves 98. Each groove 98 includes a hemispherical recess 104 at an appropriate thereof into which a corresponding ball shaped detent 106 on each tongue would fit when the block 92 or 94 is in its proper position. The seating of the ball 106 in the appropriate recess 104 would serve to lock the block 92,94 in place. Such locking mechanism may be used in all embodiments using sliding movement for the mounting.

Figure 12:
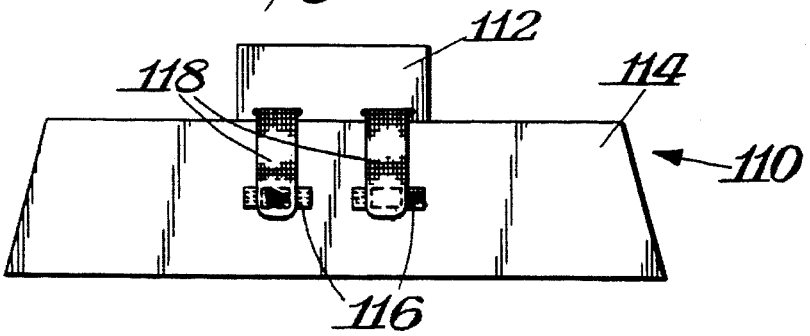
Figure 13:
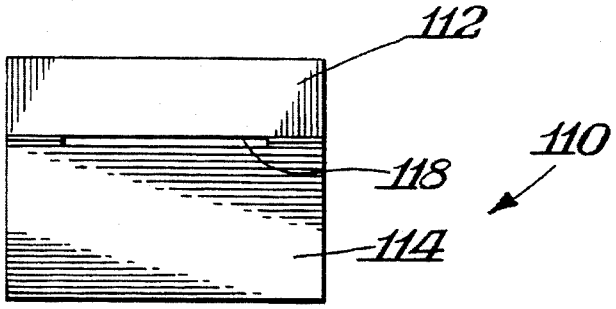
FIG. 13 is an end elevational view of the device shown in FIG. 12.

FIGS. 12–13 show a further variation of this invention wherein device 10 utilizes an alternative form of mounting means. As shown therein hook and loop mounting means is utilized for mounting each block 112 to base 114. For example, sets of VELCRO® type strips 116 would be provided at appropriate locations on base 114. Each block 112 would include a suitable number of straps 118 extending through the lower portion for the block 112 having VELCRO® formations which engage the strips 116.

Figure 14:
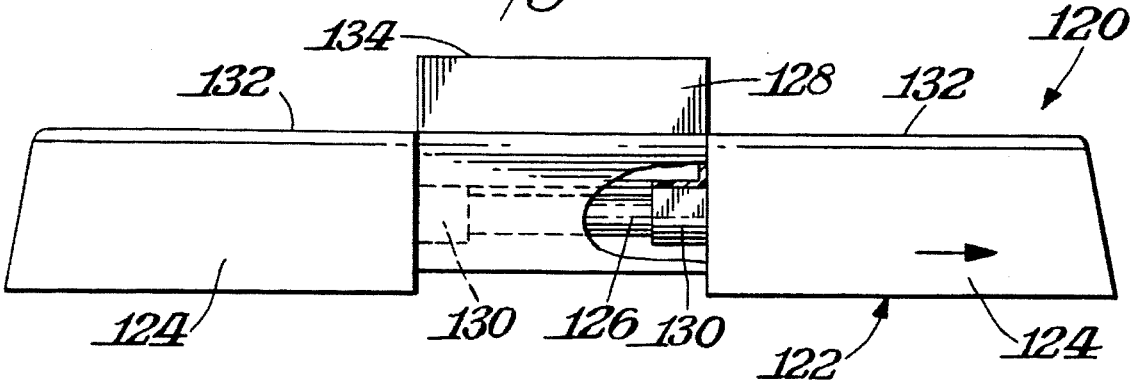
FIG. 14 is a side elevational view partly in section of yet another form of a multi-level aerobic step device in accordance with this invention.

FIG. 14 illustrates a device 120 which utilizes the features of parent patent U.S. Pat. No. 5,162,028, the details of which are incorporated herein by reference thereto, as a means of achieving multi-level heights. The principles of U.S. Pat. No. 5,162,028 are utilized with device 20 by forming base 122 with a pair of members or sections 124 which are movable away from each other as indicated by the arrow with the movement being controlled by rails 126. When sections 124 are moved away from each other the rails are exposed and a mounting block 128 is snapped into place by any suitable means such as clips 130 which snap onto rails 126. Mounting block 128 is dimensioned with respect to its height so that the upper surfaces 132 of sections 124 are at a lower (or higher) elevation than the upper surface 134 of mounting block 128. Thus, device 120 differs from the device of U.S. Pat. No. 5,162,028 where in the patent the various upper surfaces are intended to be co-planar. In the general practice of this invention the incremental difference of two levels is two inches. Accordingly, if the surface 132 is four inches above the floor surface 134 would be six inches above the floor. If desired, however, other height increments could be used by snapping different blocks onto rails 126.

Figure 15:
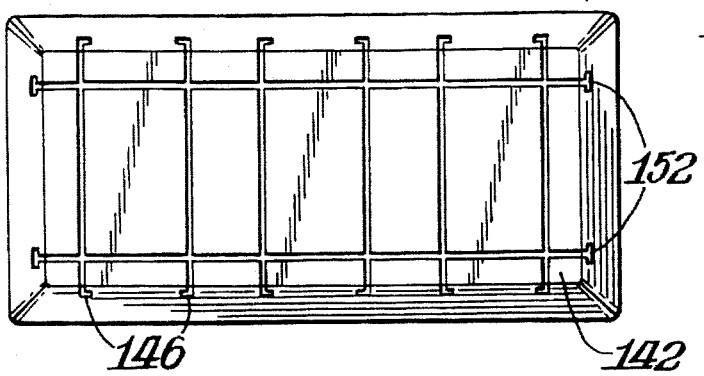
FIG. 15 is a top plan view of the base portion of a multi-level aerobic step device in accordance with this invention.
Figure 17:
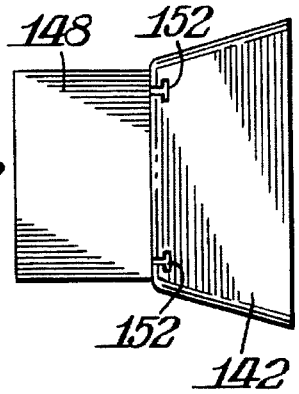
FIG. 17 is a side elevational view of the base portion shown in FIG. 15 with a mounting block mounted thereto.
Figure 16:
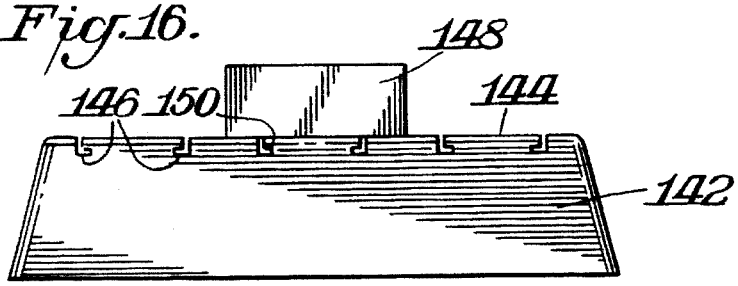
FIG. 16 is a side elevational view of the base portion shown in FIG. 15 with a mounting block mounted thereto.

FIGS. 15–17 illustrate a further device 140 in accordance with this invention wherein longitudinal and/or transverse grooves are used. As shown therein base 142 includes in its upper surface 144 a plurality of transverse L-shaped grooves 146 and longitudinal T-shaped grooves. If desired only transverse or only longitudinal grooves of either L- or T-shape may be used. Mounting block 148 in turn would have a complementary L-shaped rail 150 which would fit in the L-shaped grooves or slots 146. See FIG. 16. Alternatively, mounting block 148 could have T-shaped rails to fit in slots 152 as illustrated in FIG. 17.

Figure 18:
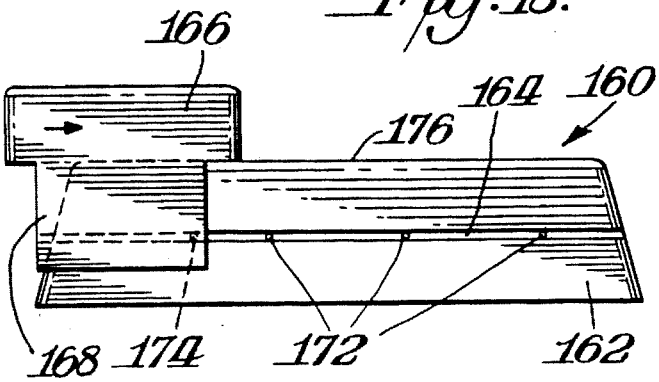
FIG. 18 is a side elevational view of yet another form of a multi-level aerobic step device in accordance with this invention.
Figure 19:
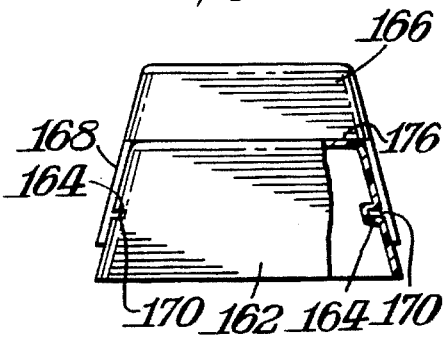
FIG. 19 is an end elevational view of the device shown in FIG. 18.

FIGS. 18–19 illustrate a further device 160 which includes a base 162 having a groove 164 formed along one and preferably each side thereof. The mounting block 166 is provided with a pair of downwardly extending aprons 168 each having a track 170 which slidably fits in groove 164. A hemispherical recess may be provided at the end of each groove into which a ball detent 174 on aprons 168 would be seated in the previously described manner. The recess and detent arrangement may also be used for controlling the specific location of block 166. FIG. 18, for example, illustrates a plurality of spaced recesses 172 with a ball detent 174 on each apron 168 positioned for selectively fitting into a corresponding recess 172 to lock block 166 in its desired position at each end of or in the central portion of the upper surface 176 of base 162. If desired, the concept of providing grooves and rails could also be effected by positioning these detachable locking members on the upper surface 176 of base 162 and lower surface of block 166 or in any other location where sliding contact is achieved between the block and base.

Where the invention is practiced with grooves which extend completely across the base or platform, one end of each groove may have a stop wall to limit the extent of movement of the rail on the corresponding part and thus prevent the sliding part slide too far.

Figure 20:
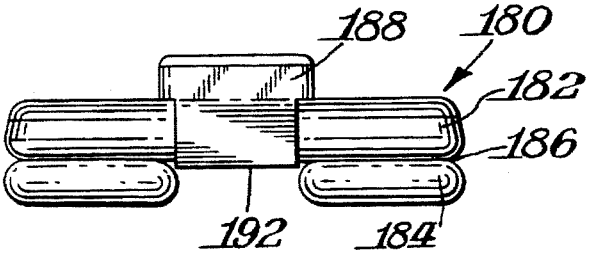
FIG. 20 is a side elevational view of yet another form of a multi-level aerobic step device in accordance with this invention.
Figure 21:
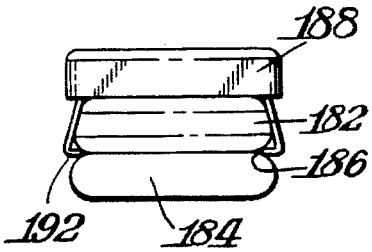
FIG. 21 is an end elevational view of the device shown in FIG. 20.

FIGS. 20–21 illustrate a further device 180 in accordance with this invention. As shown therein device 180 includes, for achieving its one level, a form of stepping device having a base 182 with the legs 184 attached below the base 182. Because of the arcuate shape of the legs 184 and the base 182 a groove 186 is formed at the junction of the legs 184 and base 182. A mounting block 188 is secured to base 182 by having an apron 190 extend from mounting block 188 and made of a springy material so that its hook end 192 would fit in the junction 186. At the central portion of device 180 where there is no leg below base 182 (FIG. 20) the hook end 192 would simply fit in the curved area at the lower portion of base 182.

FIGS. 22–23 show a further device 200 which includes a base 202 having a mounting block 204 on the flat upper surface 206 of base 202. Base 202 includes locking members in the form of a plurality of holes 208, 210, 212, 214 on each of its side walls. Mounting block 204 in turn is provided with an apron 216 on each side with apron 216 having complimentary locking members in the form of a pair of pins 218 as best shown in FIG. 23. Mounting block 204 could be locked in one of three positions. An extreme left position would be achieved when the two pins 218 are located in holes 208 and 210. A central position could be achieved when pins 218 are located in holes 210 and 212. An extreme right position could be achieved when pins 218 are located in holes 212 and 214. The springy material of apron 216 assures retaining the pins in the corresponding holes while permitting the pins to be removed when it is desired to change the position of mounting block 204 or to completely remove the mounting block. This embodiment of the invention may be practiced with more than four holes so as to provide a greater variety of possible locations for the mounting block. Additionally, more than one mounting block could be simultaneously mounted on the base to provide three or more height levels.

FIG. 24 illustrates a variation of device 200 wherein the holes 220 are formed in the apron 216 and pins 222 are provided at spaced locations on the base 202 which would be simply a reversal from FIGS. 22–23 in the use of holes and pins.

FIGS. 25–26 illustrate a further device 230 in accordance with this invention. As shown therein a base 232 has a mounting block 234 selectively secured thereto. The means of detachable mounting is achieved by providing legs or extensions 236 downwardly from mounting block 234. The legs 236 would be angled to conform to the sloping sides of base 232. Legs 236 would then terminate in horizontal hooks 238 which would slide under base 232. If desired, base 232 could be notched at selected locations so that the lower surface of base 232 would terminate co-planar with the lower surface of hook 238.

In the various embodiments illustrated in FIGS. 1–26 the multi-level is achieved by mounting a mounting block on a base. It is to be understood, however, that the invention may also be practiced where the mounting blocks are mounted below the base. FIG. 27, for example, illustrates a device 240 which includes a base 242 which may take the form of any of the previously described bases. A pair of mounting blocks 244, 245 are detachably secured to and below base 242. The result is a plurality of exposed flat surfaces comprising lower surfaces 246, 247 from mounting blocks 244, 245 and upper elevation surface 248 from base 242. The mounting blocks may be formed identically with each other so that their exposed upper surfaces 246, 247 are at the same height level. Alternatively, as illustrated, the mounting blocks could be of different structure such as by mounting block 245 having a shoulder 250 abutting against base 242. This would result in the exposed upper surface 247 of mounting block 245 being at a higher elevation than the exposed upper surface 246 of the other mounting block 244 so that three levels are formed.

It is to be understood that the various embodiments described herein may be practiced by incorporating features of one embodiment into any of the other embodiments where suitable. Similarly, the various means described in the parent patents and applications with regards to the mounting of legs to the base may also be utilized as a means for mounting the mounting blocks to the base where appropriate. It is also to be understood that although the various figures illustrate the components in the devices to generally have tapered sides the sides may be straight. Additionally, it is to be understood that where various platforms are illustrated without the illustration of legs to provide additional height adjustability, those practices may be modified to include legs as described in the parent patents and applications.

An advantage of using height adjustable steps as the base is that the user has the option of adding one or more mounting blocks for a multi-level exercise or simply using the base alone for the known single level exercise. Alternatively, the base may be any structure capable of being coupled to at least one mounting block for achieving the multi-levels.

What is claimed:

1. A multi-level aerobic stepping device comprising: a base having a flat upper and lower surface and a longitudinal length, a mounting block having a flat upper surface, a flat lower surface and a longitudinal length, the longitudinal length of said mounting block being less than the longitudinal length of said base, aprons on the sides of said mounting block extending downwardly below said lower surface of said mounting block and being in contact with said base below said upper surface of said base, locking elements on said aprons and complementary locking elements disposed on and spaced along the length of said base, detachably mounting said mounting block on said upper surface of said base and for varying the mounting location of said mounting block along the length of said base, thereby providing a stepping unit having a lower surface which is adapted to be disposed on a floor, said stepping unit having an exposed upper surface which comprises a plurality of stepping sections, one of said stepping sections being at least a portion of said upper surface of said mounting block and a second of said stepping sections being a portion of said upper surface of said base, said stepping sections being at different heights and of a size of sufficient area to support the entire foot of a user.

2. The device of claim 1 including at least two of said mounting blocks mounted to said base to form at least three spaced stepping surfaces.

3. The device of claim 2 wherein said base is hollow and open at its lower surface, and said mounting blocks being nestable in said base during periods of non-use.

4. The device of claim 1 wherein all of said surfaces are at different elevations with respect to each other.

5. The device of claim 1 wherein said locking elements comprise pins and holes formed in said base and said aprons.

* * * * *